US005937765A

United States Patent [19]

Stirling

[11] Patent Number: 5,937,765

[45] Date of Patent: Aug. 17, 1999

[54] LEG-SUPPORTED PLATFORM FOR LAPTOP COMPUTERS

[75] Inventor: Christopher M. Stirling, Blaine, Wash.

[73] Assignee: Rach, Inc., Blaine, Wash.

[21] Appl. No.: 08/846,662

[22] Filed: May 1, 1997

[51] Int. Cl.[6] ..... A47B 23/00

[52] U.S. Cl. ..... 108/43

[58] Field of Search ..... 108/43, 45, 42; 248/444

[56] References Cited

U.S. PATENT DOCUMENTS

| | | | |
|---|---|---|---|
| 2,670,260 | 2/1954 | Watt | 108/43 X |
| 2,701,173 | 2/1955 | Senior et al. . | |
| 3,828,696 | 8/1974 | Lochridge | 108/43 |
| 4,103,809 | 8/1978 | Frost et al. . | |
| 5,081,936 | 1/1992 | Drieling | 108/43 |
| 5,090,334 | 2/1992 | Sutton | 108/43 |
| 5,263,423 | 11/1993 | Anderson | 108/43 |
| 5,355,811 | 10/1994 | Brewer | 108/43 |
| 5,680,973 | 10/1997 | Vulpitta et al. | 108/43 X |
| 5,687,422 | 11/1997 | Wurst et al. | 108/43 X |
| 5,713,548 | 2/1998 | Boyer et al. | 108/43 X |

FOREIGN PATENT DOCUMENTS

| | | | |
|---|---|---|---|
| 103154 | 1/1917 | United Kingdom | 108/43 |

*Primary Examiner*—Jose' V. Chen
*Attorney, Agent, or Firm*—Todd N. Hathaway

[57] ABSTRACT

A leg-worn support assembly for a laptop computer. There is a substantially planar, rigid platform for attachment to the computer, and first and second tensioned leg straps which depend from the edges of the platform for extending around the user's leg. A pad is mounted on the lower surface of the platform and has a channel area therein for engaging the upper edge of the leg. Non-slip surfaces are formed on both the leg straps and the channel area for frictionally engaging the leg so as to provide a stable work platform.

10 Claims, 6 Drawing Sheets

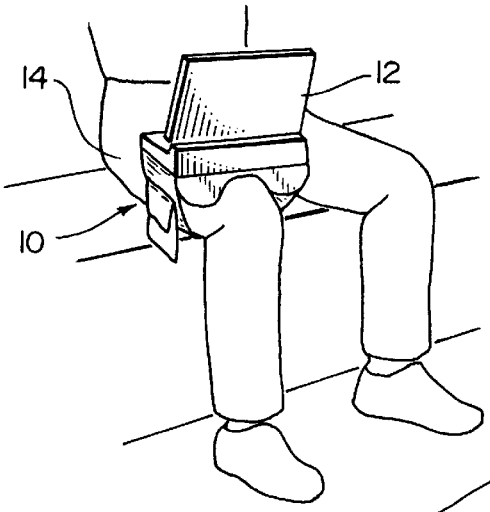
FIG. 1
FIG. 2
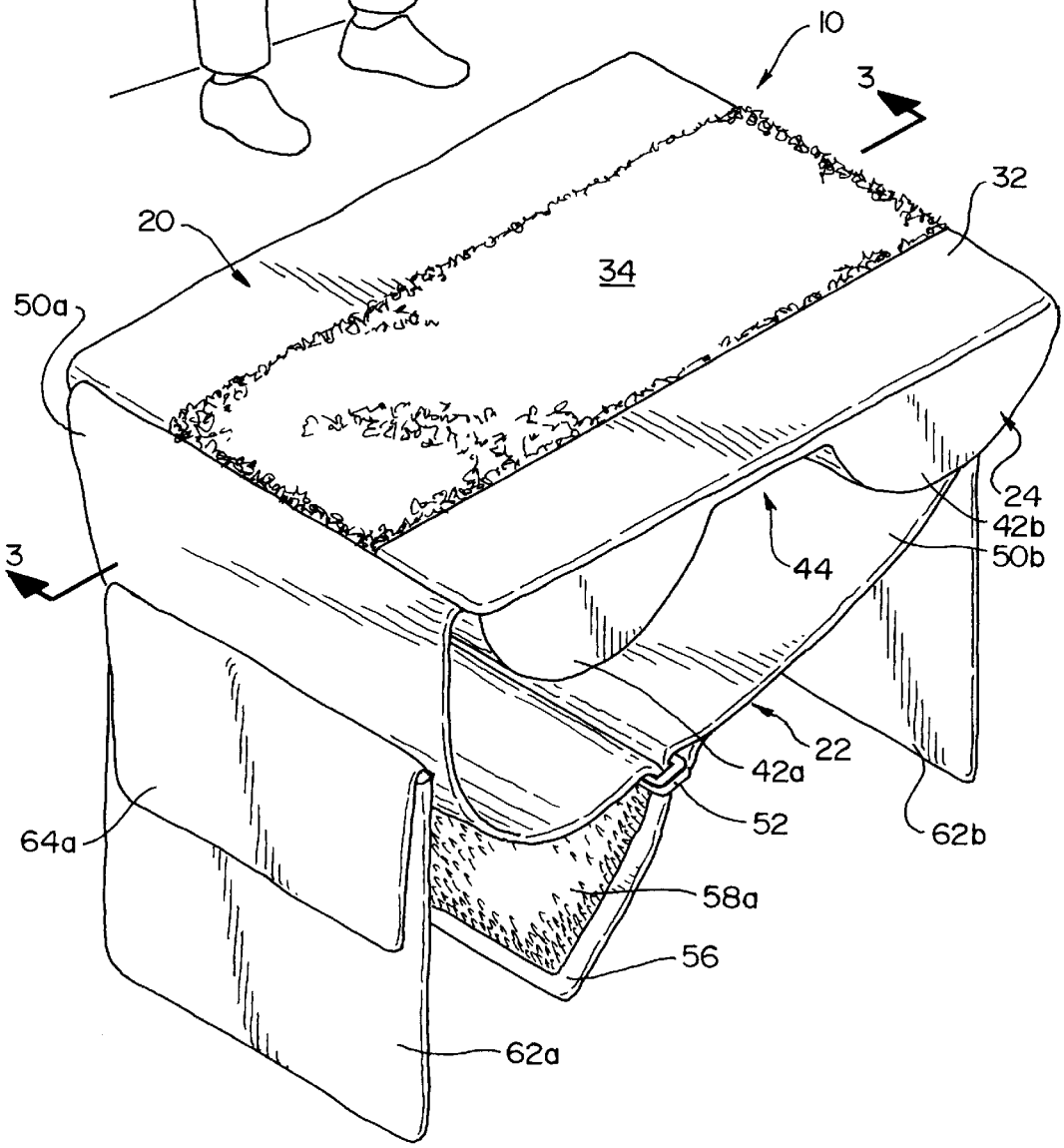

LEG-SUPPORTED PLATFORM FOR LAPTOP COMPUTERS

BACKGROUND OF THE INVENTION a. Field of the Invention

The present invention relates generally to accessories for computers, and, more particularly, to an attachment for supporting a laptop-type computer on the user's leg while in a seated position.

b. Background Art

Portable "laptop" computers have become increasingly popular, particularly with people who desire to use a computer while travelling. Typically, the laptop computer has a shallow, rectangular case with a flip-up screen. Common dimensions are in the range of about 12 inches by 9 inches by 2.5 inches high, although these figures vary considerably from model to model.

Almost universally, laptop computers have a flat, planar bottom surface which is designed to rest on a desk, table, or the like. A problem for travellers, however, is that such flat work surfaces are often not available. For example, a person desiring to use his laptop computer while in an airport waiting area or in a lecture/conference room frequently will not have a table top or other flat surface available on which to work. As a result, and as is commonly seen in these circumstances, the laptop users resort to balancing the devices on their knees while operating the keyboard, often assuming inconvenient and uncomfortable positions to accomplish this. Also, the difficulty of trying to hold the computer steady with one's hands while simultaneously typing tends to adversely affect the person's work efficiency. Moreover, under these circumstances it is very easy for the computer to slip off of the person's knees and fall onto the floor, possibly resulting in serious damage to the machine.

Accordingly, there exists a need for an apparatus which will enable a person to conveniently operate a laptop computer in the absence of an available flat work surface. Moreover, there is a need for such an apparatus which will firmly hold the computer in position while leaving the person's hands free to operate the keyboard. Still further, there is a need for such an apparatus which will obviate any possibility of the computer becoming dislodged and falling during use.

SUMMARY OF THE INVENTION

The present invention is a leg-worn support assembly for a laptop computer. Broadly, this comprises a substantially planar, rigid platform member having an upper surface for attachment to a laptop computer, a pad member mounted to a lower surface of the platform member, the pad member forming a channel area for receiving an upper edge of a user's leg, first and second leg straps mounted to first and second edges of the platform member and depending therefrom for extending around a user's leg, and means for connecting the ends of the first and second leg straps around a user's leg so as to press the upper edge of the leg into the channel area when the support assembly is worn thereon.

The pad member may comprise a cushioning pad member having the channel area permanently formed therein, such as first and second pad portions which are spaced apart to define the channel area, or a substantially unitary pad member having a permanently formed depression in a lower surface thereof which defines the channel area. Alternately, the pad member may comprise a deformable cushioning pad member in which the channel area is formed by pressure of the upper edge of a user's leg against the pad member.

The support assembly may further comprise means for detachably mounting a laptop computer to the platform member. The detachable mounting means may comprise a first layer of a hook-and-loop material mounted to the upper surface of the platform member, and a second layer of the material mounted to a lower surface of the laptop computer for detachably engaging the first layer of material on the platform member.

The first and second leg straps may comprise tension means for pressing the pad portion downwardly against the upper surface of the user's leg when the straps are connected around the leg. The tension means may be a cinch ring connected to the straps, a separate tensioning strap mounted to the outer surface of at least one of the leg straps, or an elastomeric segment mounted in at least one of the leg straps between upper and lower portions thereof.

The support assembly may further comprise a non-slip surface formed on an inner surface of a selected one of the leg straps for bearing against and frictionally engaging a lower surface of a user's leg, and there may also be a non-slip surface formed on the channel area for bearing against and frictionally engaging the upper surface of the leg. The non-slip surface on the leg strap may be located at a position along the strap which is selected so that it will be positioned in substantially vertical alignment with and diametrically opposite the non-slip surface on the channel area when the assembly is worn on the user's leg.

The means for connecting the ends of the leg straps around the user's leg may comprise a first layer of hook-and-loop material mounted on an outer surface of an end of the first leg strap, and a second layer of the hook-and-loop material mounted on an inner surface of an end of the second strap which overlaps the end of the first strap so that the layers of hook-and-loop material overlie and engage one another when the straps extend around a user's leg.

The assembly may further comprise an upper cover member which is detachably mounted around an edge of the rigid platform member, for enclosing the laptop computer when the latter is not in use.

BRIEF DESCRIPTION OF THE DRAWINGS

FIG. 1 is a perspective view of a support apparatus in accordance with the present invention, showing this supporting a laptop computer on the leg of a person in a seated position;

FIG. 2 is an enlarged perspective view of the support apparatus of FIG. 1, showing the upper support surface to which the computer detachably mounts, and the pad and strap assemblies which secure the support apparatus to the person's leg;

DETAILED DESCRIPTION

Figure 3:
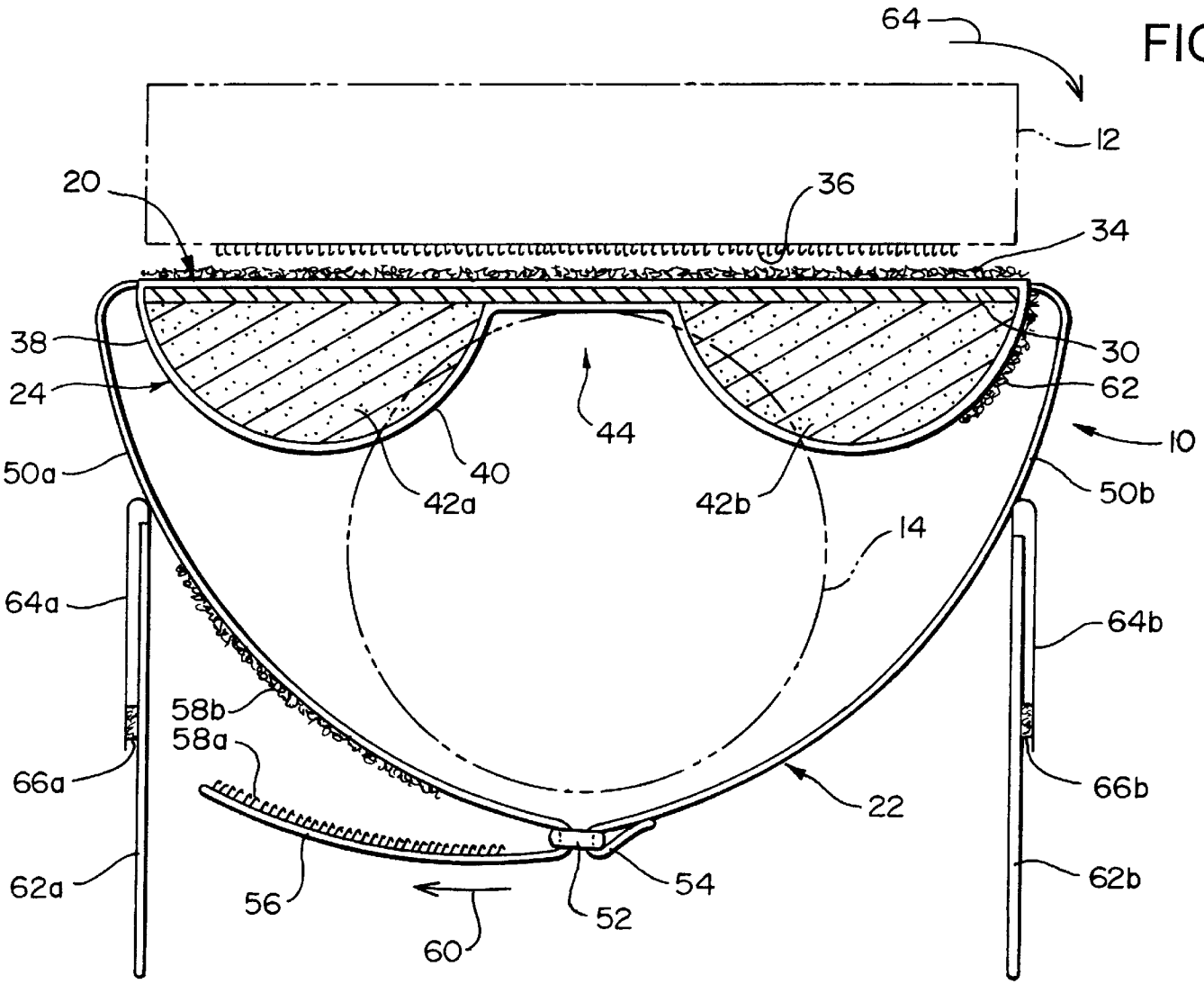
FIG. 3 is a cross-sectional view of the apparatus of FIGS. 1–2, taken along line 3—3 in FIG. 2, showing the manner in which this engages the person's leg so as to provide a stable support platform for the laptop computer which is mountable thereto.

FIG. 1 shows a support assembly 10 in accordance with the present invention, being used to support a conventional laptop computer 12 on a person's upper leg 14. As can be seen, the support apparatus 10 thus securely positions the computer in an ideal location for the person to operate the keyboard.

As can be seen in FIG. 2, the principal components of the assembly 10 include a planar support plate portion 20, an adjustable leg band portion 22, and a contoured leg pad portion 24. Preferable, all of these components are provided with a fabric covering, such as a covering formed of Cordura™ fabric or a similar heavy cloth or canvas material.

In the embodiment of the invention which is illustrated in FIGS. 1–3, the plate portion 20 of the assembly has an internal, rigid panel member 30 which forms a rectangular, planar top surface 32 which corresponds generally to the bottom surface of a conventional laptop computer, such as that shown in FIG. 1; the panel member 30 may be formed of any suitable, preferably substantially rigid material, such as rigid plastic, fiberglass, metal, wood, or pressboard, for example. Owing to the dimensional differences between various models of computers, the length and width of the top surface may be selected to correspond generally to an "average" size, rather than being an exact match to the computer case.

As noted above, the top surface 32 of the plate portion 20 is preferably covered with a heavy cloth material. Also, as can be seen in FIG. 2, a broad band 34 of hook-and-loop fabric material extends across the top surface 32, to provide the means for detachably mounting the computer to the plate portion; as can be seen in FIG. 3, the first layer of the hook-and-loop material (e.g., the "loop" layer) is sewn, adhered, or otherwise permanently attached to the top of the plate portion 20, while the second layer 36 of the hook-and-loop material (e.g., the "hook" layer) is permanently mounted to the bottom surface of the computer case 12. For example, Velcro™ hook-and-loop material is commonly supplied with an adhesive backing, by which the layer 36 of material, in the form of a continous strip or sheet or a series of separate "buttons", can be mounted to the bottom of the plastic computer case. Using broad bands of the Velcro™ or other hook-and-loop material provides a very secure mounting of the computer case to the plate portion of the assembly, and allows the operator to detach the computer at will so as to be able to use this on top of a desk or table in a conventional manner.

The pad portion 24 of the assembly, in turn, mounts to the underside of the rigid plate member 30. The pad portion provides a lower surface 40 having a contour which corresponds generally to that of the upper surface of the person's upper leg 14. In the embodiment which is illustrated in FIGS. 1–3, the pad portion is formed by first and second semi-cylindrical pad members 42*a,* 42*b* which depend from the undersides of the right and left ends of the rigid plate member; pad members formed of high-density foam rubber or similar material are eminently suitable for this purpose. The width of each of the pad members is sized somewhat less than half the width of the plate member 30, so that an upwardly extending channel area 44 is formed which extends down the centerline of the platform portion and generally parallel to the axis of the upper leg 14. The channel area 44 is thus configured to receive and engage the upper surface of the person's thigh, so as to firmly center the platform portion 20 on the person's leg and stabilize this against rocking and side-to-side movement. In the embodiment which is illustrated, the flat upper surfaces of the semi-cylindrical pad members 42*a,* 42*b* are attached adhesively to the bottom of the rigid panel member 30 and are covered by the same fabric enclosure 38 that extends over the top of the platform, although foam members having a finished lower surface may be used without a fabric cover across the bottom of the device. Also, it will be understood that a pad portion suitable for use in the present invention, which defines a channel area for engaging the upper surface of the person's leg, may be provided by other suitably configured members, such as a unitary, molded structure formed of a resiliently compressible or substantially rigid material, for example; moreover, in some embodiments the pad portion may be formed integrally with the plate portion of the assembly, or possibly even unitarily with the case of the computer itself.

The leg band portion 22 of the assembly, in turn, is formed by first and second strap members 50*a,* 50*b* having upper ends which are attached along the right and left ends of the platform portion 20. The strap members may be formed of any suitable material, with the same heavy fabric material as the cover 38 being eminently suitable for this purpose.

To provide maximum stability and user comfort, the straps 50*a,* 50*b* are preferably relatively wide bands. As can be seen in FIGS. 2 and 3, a long, narrow cinch ring 52 is permanently attached to the lower end of one of the strap members 50*b* by a loop 54 formed along the bottom edge thereof, and this receives the loose end 56 of the other strap member 50*a;* in some embodiments, the cinch ring may be located off-center, so that this is positioned somewhat up along the side of the person's leg for ease of access. A first layer 58*a* of hook-and-loop fabric material is mounted to the outer surface of the strap member 50*a* below the cinch ring, and a corresponding layer 58*b* of the hook-and-loop material is mounted to the outer surface of the strap member above the ring. Thus, by feeding the loose end of the strap member 50A through the cinch ring and pulling on this in the direction indicated by arrow 60 in FIG. 3, the person is able to tighten the leg band to the desired degree, then press the two layers of Velcro™ material 58*a,* 58*b* together so as to secure the strap in place.

As is also shown in FIGS. 2 and 3, the leg band portion of the assembly is optionally provided with pockets 62*a,* 62*b* for holding various items, such as computer diskettes. As is shown, these may be suitably formed of the same heavy fabric material as the cover and straps of the assembly, and these may be provided with closure flaps 64*a,* 64*b* which are secured by Velcro™ patches 66*a,* 66*b.*

An additional strip of the Velcro™ material (the loop layer, in the embodiment which is illustrated) is mounted along the outside of the pad member 42, on the side which is opposite strap member 50*a*. When the assembly is removed from the leg, this enables the user to lay the first strap member 50*b* across the top of the computer case 12, and then pull the other strap member 50*a* tight across the top of this, in the direction indicated by arrow 64 in FIG. 3, with the loose end 56 of the strap member 50*a* then being secured in place by the engagement of the Velcro™ layers 58*a* and 62. In this configuration, the assembly 10 provides a protective case for the computer when it is not in use; also, because the two pockets 62*a,* 62*b* lie flat against the upper surface of the computer case, any diskettes therein are protected against bending during transportation and handling.

The present invention thus provides a stable platform for holding a laptop computer in a convenient location for a person to operate this while in a seated position. Moreover, the person is not limited to having to assume one position in order to operate the computer; the person is free to shift his legs about while operating the computer, and can cross his legs, lean back, and otherwise adjust his position as necessary or desired in order to remain comfortable.

Figure 4:
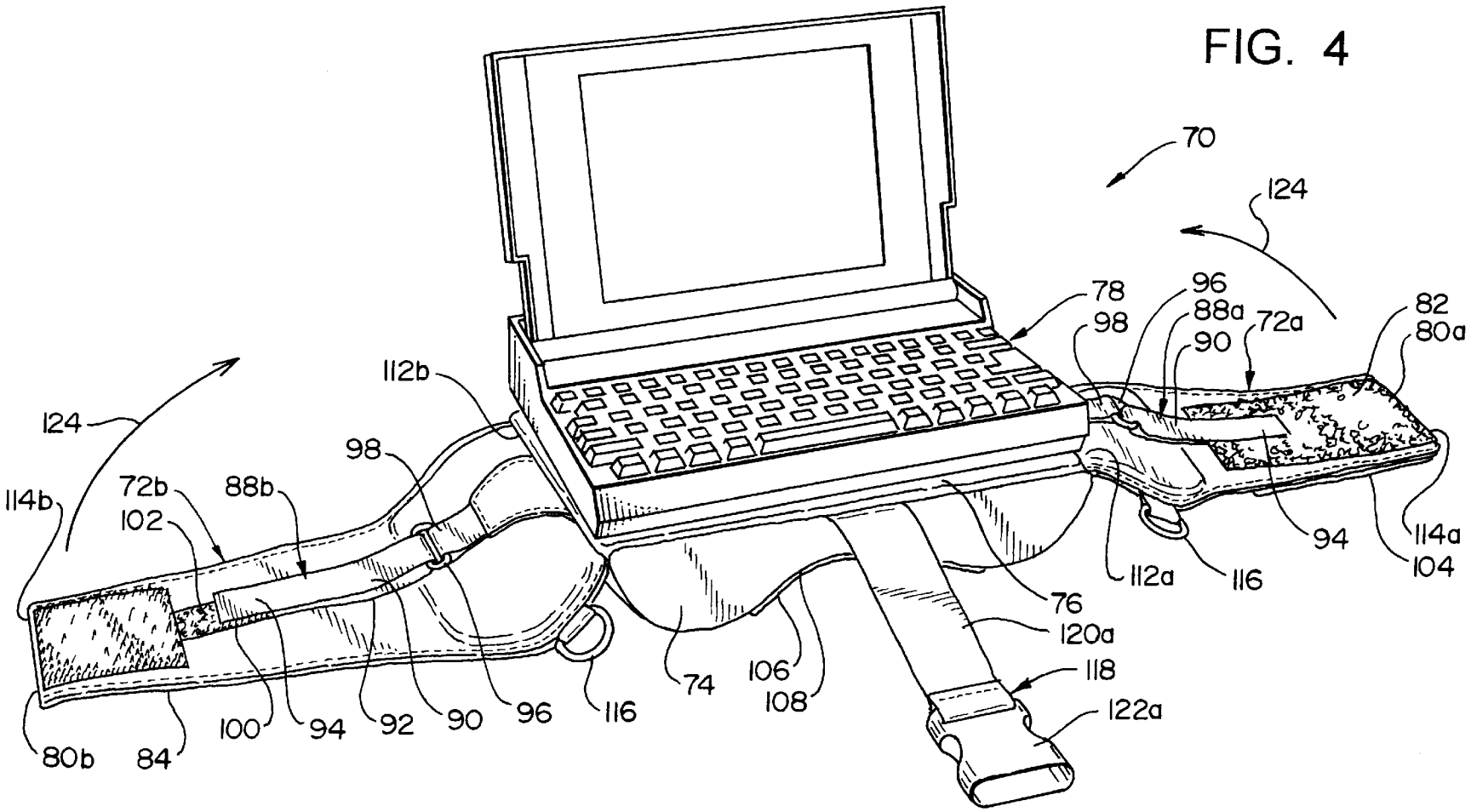
FIG. 4 is a perspective view of a support apparatus in accordance with the second embodiment of the present invention, showing the leg straps spread apart and the adjustable tension straps which are mounted on the outer side of each of the leg straps.

FIG. 4 shows a support assembly unit 70 in accordance with a second embodiment of the present invention, which differs from that shown in FIGS. 1–3 primarily in the configuration of the leg straps 72*a,* 72*b,* and in the contour of the pad portion 74 which engages the person's leg. The panel member 76 and the manner in which this engages and supports the laptop computer 78 are substantially the same as previously described.

As can be seen in FIG. 4, the leg straps 72*a,* 72*b* in this embodiment are not threaded through a cinch ring, but instead are provided with overlapping outer ends 80*a,* 80*b* upon which are mounted patches of Velcro™ or other hook-and-loop material. In particular, the first end 80*a* has a patch 82 of the "loop" layer of the material mounted on its outer surface, while the end 80*b* of the opposite leg strap has a corresponding patch 84 of the "hook" material on its inner surface. Thus, when the two straps 72*a,* 72*b* are wrapped under the person's leg 86, as shown in FIG. 5, the hook-and-loop layers 82 and 84 come into engagement to hold the overlapping ends of the straps in place.

The two leg straps 72*a,* 72*b* are also provided with adjustment straps 88*a,* 88*b* which allow the tension of the leg straps to be adjusted. As can be seen, each of the adjustment straps 88 includes an elongate strap member 90 having a first end 92 which is stitched or otherwise attached to the outside surface of the leg strap 72 at a location towards the middle thereof, and a loose end 94 which is threaded through a buckle member 96. The buckle member is attached to an upper portion of the leg strap by a short fabric loop 98, and the loose end of the strap member 90 is passed through the buckle and bent back upon itself to a point below the attachment point of the fixed end. A patch 100 of the "hook" layer of Velcro™ (or other hook-and-loop material) is mounted on the underside of the of the loose end of the strap member, so that this can be pressed into engagement with a corresponding "loop" layer of the material to secure the end 94 of the strap in place. As can be seen in FIG. 4, the "loop" layer of material may be arranged as a vertical band 102 on the outer surface of the leg strap 72*b* having the main "hook" layer on its inner surface, or may be a part of the main "loop" layer 82 on the outer surface of the other leg strap 72*a.*

Figure 5:
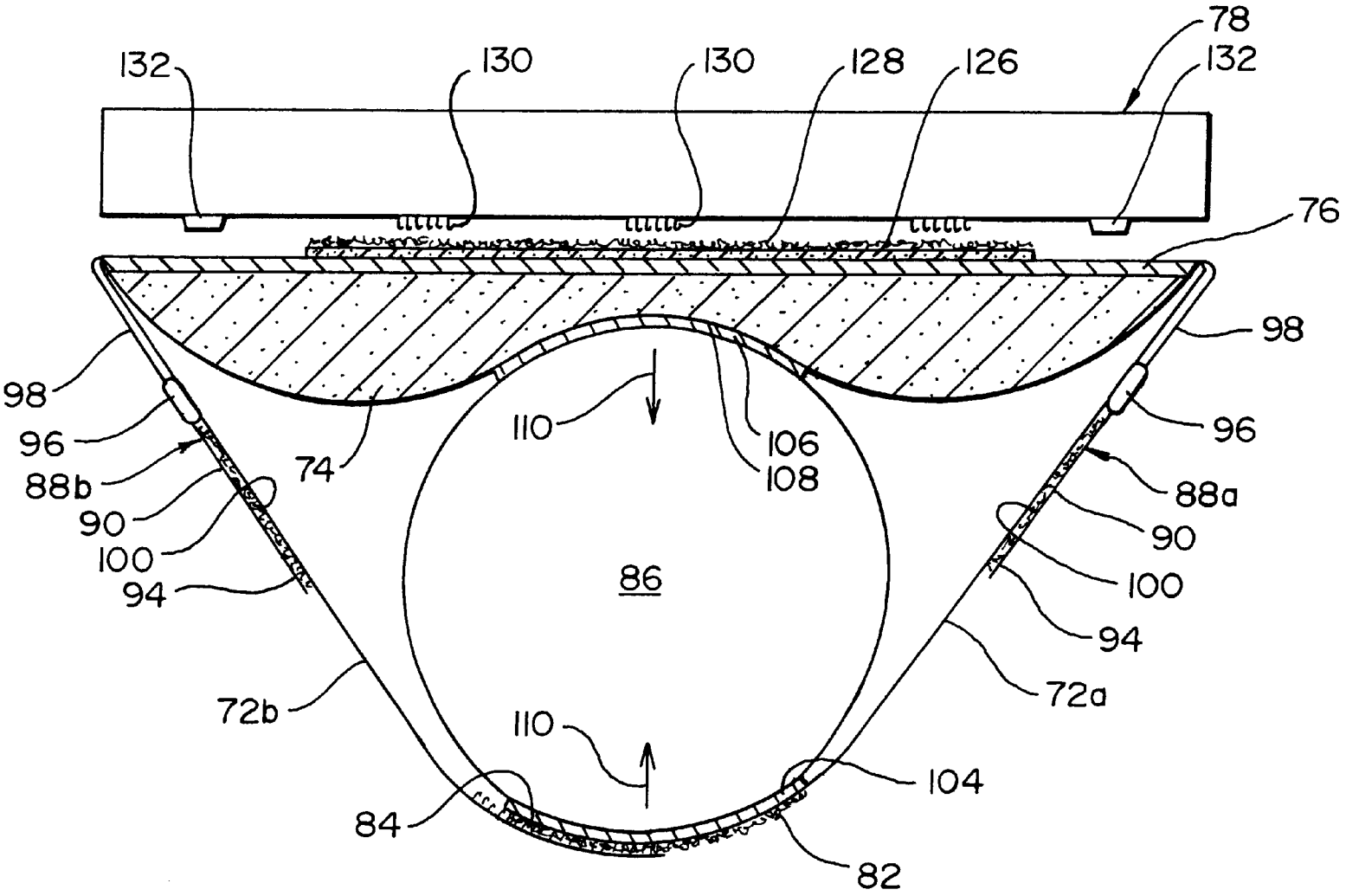
FIG. 5 is a cross-sectional view of the support apparatus of FIG. 4, this being somewhat similar to FIG. 3 in showing the manner in which the support apparatus of FIG. 4 engages the person's leg, with the straps wrapped under the person's leg and upper and lower non-slip surfaces positioned on diametrically opposite sides of the leg.

Thus, to install the assembly on a leg as shown in FIG. 5, the user first pulls the ends 94 of the adjustment straps loose from the Velcro™ patches on the outer surfaces of the leg straps 72, and then passes the leg straps underneath the thigh and presses the overlapping ends together to hold the assembly in place. The ends of the two adjustment straps are pulled downwardly along the sides of the leg to achieve the desired tension, and are then pressed against the Velcro™ patches on the outer surfaces of the leg straps to secure them in place.

The first leg strap 72*a* also includes a non-slip layer 104 on its inner surface, extending near its end and generally opposite the Velcro™ loop material 82 on its outer surface. As can be seen in FIG. 5, this serves to position the non-slip layer 104 directly against the bottom surface of the leg 86, so as it is pressed against the leg by the tension of the straps. A second layer of non-slip material 106 is mounted in the channel area 108 of the pad portion 74, so that the two non-slip surfaces are positioned in generally vertical alignment on diametrically opposite sides of the leg 86. The tension of the leg straps thus forces the two non-slip surfaces towards one another, in the direction indicated by arrows 110 in FIG. 5, forming a firm frictional engagement with the leg and/or clothing, thereby providing a highly stable platform for supporting the computer. A suitable non-slip material for use in the present invention is that which is available under the trademark Toughtek™ from Harrison Technologies, Gloversville, N.Y., U.S.A.

As can also be seen in FIG. 5, the pad portion 74 in this embodiment of the invention is formed from a unitary piece of foam or other padding material with a depressed channel area having a concave, generally cylindrically-curved contour which generally corresponds to the upper surface of the leg.

Also, in this embodiment of the invention, the leg straps 72 are generally tapered towards their lower ends. This provides the straps with wide upper ends 112*a,* 112*b* which attach along the full width of the edges of the plate member 76 for maximum stability. The narrower, tapered lower ends 114*a,* 114*b,* in turn, provide clearance behind the person's knee, so that the assembly can be positioned closer to the end of the thigh for maximum flexibility and comfort. Suitable dimensions for the leg straps having this configuration have been found to be approximately 12" long, tapering from 9" wide at the upper edge to 4" wide at the bottom.

Each of the leg straps 72 is also preferably provided with a D-ring 116 or similar mounting point for optional attachment of a pouch or other container for holding spare diskettes, pencils/pens, and other articles. Also, a transverse strap assembly 118 having first and second segments 120*a,* 120*b* (the second segment not being visible in FIG. 4) is preferably included, the ends of which carry the two parts 122*a,* 122*b* (122*b* again not being visible in FIG. 4) of a Fastek™ buckle or similar coupling. This provides a secondary strap which extends over the top of the computer 70 when its screen is folded down, so as to hold the computer securely in place while the assembly is being carried; as with the embodiment described above, the first and second leg straps also fold over the top of the computer when the latter is not in use, as indicated by arrows 124 in FIG. 4, so as to retain the computer in the direction opposite the transverse strap 188 and to also provide an additional impact-absorbing/cushioning layer for the computer.

FIG. 5 also shows the thin layer of cushioning material 126 which is mounted on the platform 76 in some embodiments to provide a raised "island" for the layer of Velcro™ material 128 which is mounted on top of this. This arrangement ensures proper contact with the small Velcro™ or other hook-and-loop patches 130 (e.g., Velcoin™ patches) which are mounted on the underside of the computer case, and prevents the legs 132 on the bottom of the computer case from interfering with this engagement. Also, the platform helps to raise a substantial portion of the lower surface of the computer away from the platform 76, thereby providing a gap for enhanced heat ventilation. Preferably, the raised "island" is sized so that it will fit between the legs on the bottom of the majority of laptop computers, and an 8" square, ⅛" high island has been found to be an eminently suitable size. A suitable cushioning material for forming the island is ⅛" thick No. 2 closed cell foam, although any other suitable material may be used for this purpose.

Figure 6:
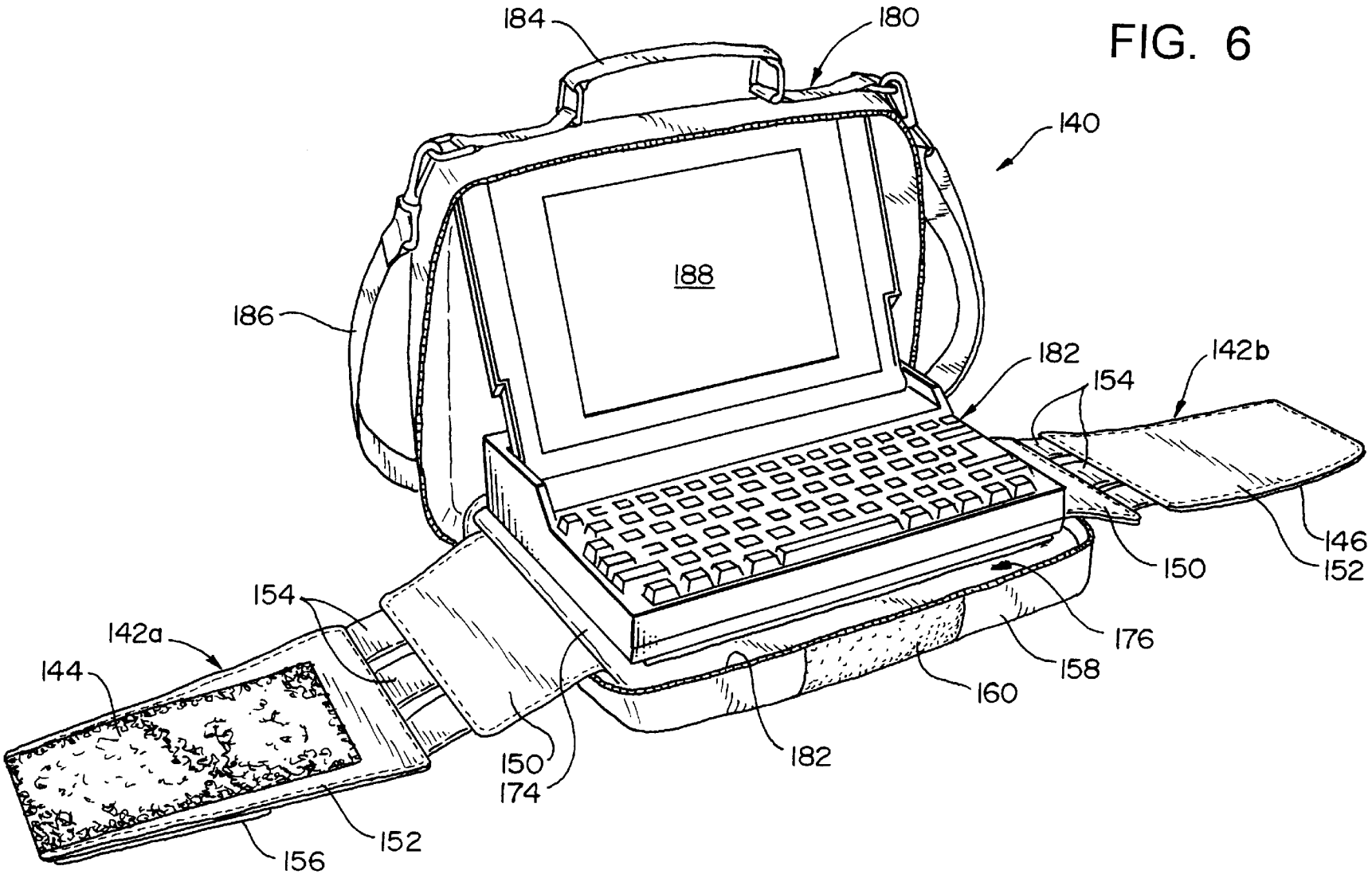
FIG. 6 is a perspective view, similar to FIG. 4, showing a support apparatus in accordance with another embodiment of the present invention, this having a detachable outer case which encloses the computer for transportation, and in which the pad portion is substantially flat in its initial configuration but compresses to form the channel area when pressed against the top of the person's leg by the leg straps.

FIG. 6, in turn, shows a support assembly 140 in accordance with another embodiment of the present invention, which differs somewhat from that shown in FIGS. 4–5 in the configuration of the leg straps and pad portion, and also in the addition of a top cover for completely enclosing the computer when not in use.

Figure 7:
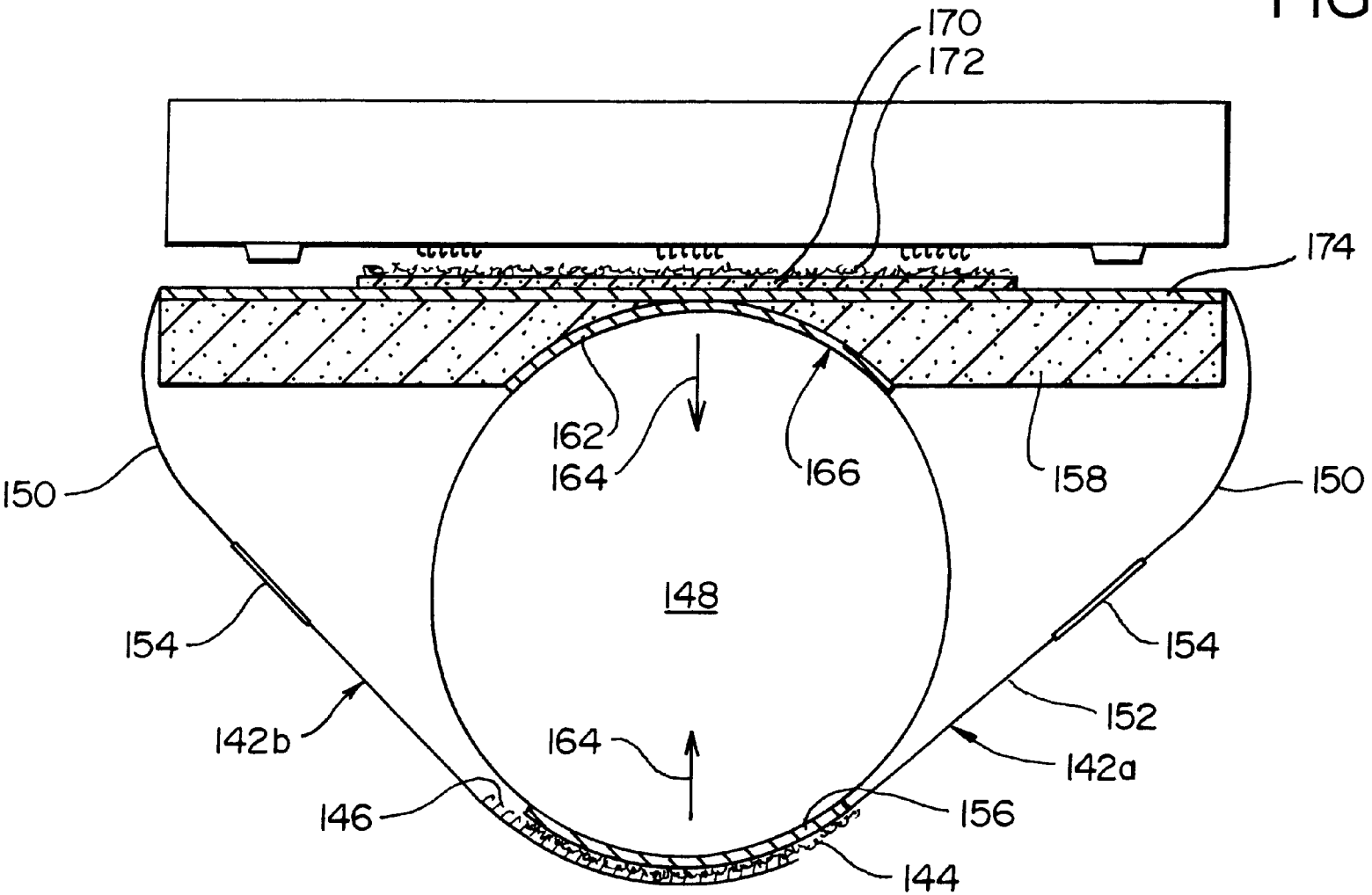
FIG. 7 is a cross-sectional view similar to FIG. 5, showing the manner in which the apparatus engages the person's leg and the stabilizing channel area is formed in the lower pad portion of the assembly.

In particular, the first and second leg straps 142*a,* 142*b* have loop and hook layers 144 and 146 on their outer and inner surfaces, respectively, which are joined together below the user's leg 148 in substantially the same manner as described above. In this embodiment, however, each leg strap 142 is divided into upper and lower sections 150, 152 which are connected by a series (e.g., three) of parallel, vertically-extending, elastomeric strap segments 154. The strap segments 154 may be formed of any suitable elastomeric material, such as doubled-over 1½" heavy weight elastic webbing, for example, and these serve to create the desired tension on the straps when installed around the leg as shown in FIG. 7. Although a single-wide elastomeric strap segment may be used in some embodiments in place of the plurality of segments 154 which are shown in FIG. 6, the latter arrangement is generally preferred because it allows a degree of lateral movement of the lower portion of the leg strap while maintaining a steady pull along the edges of the platform and without buckling the elastomeric segement.

As with the embodiment described above, the first leg strap 142*a* also includes a non-slip surface 156 which is configured to press against and frictionally engage the bottom of the wearer's leg. In the embodiment which is shown in FIGS. 6–7, however, the upper channel area in the cushion portion is not permanently formed, but instead the bottom surface of the cushion portion 158 is generally planar in its uncompressed condition, with the upper layer of non-slip material 160 extending across the middle of this along the line of the wearer's leg. This is underlain by a layer of compressible foam material 162, however, so that when the pad portion is pressed against the upper side of the leg by the tension of the strap segments 154 or other tension means, in the direction indicated by arrows 164 in FIG. 7, the foam material compresses so as to form the channel area 166 which receives the upper edge of the leg. Then, when the assembly is removed from the wearer's leg, the bottom of the pad portion returns to its planar configuration; this has the advantage of presenting a conventional, flat-sided look when the unit is carried as piece of luggage.

The cushioning layer of the compressible pad portion which is shown in FIG. 7 may suitably be formed of 1" thick RA30-145 foam material available from American Excelsior, Yakima, Wash., U.S.A. Although other suitable materials may be used, the density and other characteristics of the material should be selected so as to avoid excessive thicknesses which would result in an overly bulky assembly.

FIG. 7 also shows the raised, central "island" 170 for the Velcro™ surface 172 on panel member 174, as described above.

An additional feature of the embodiment which is shown in FIG. 6 is the inclusion of a fabric cover assembly 180 which forms a box-like "clam shell" structure for enclosing the computer 182 during transportation/storage. This attaches to the upper edge of the pad portion 158 by means of a zipper 182 or similar fastening mechanism, and includes a carrying handle 184, shoulder strap 186, and a plurality of carrying pockets (not visible in FIG. 6) for diskettes, pencils/pens, files, and other items which the owner may wish to carry. The upper cover may be completely removed, or the last leg of the zipper (across the back of the computer) may be left attached so as to form a hinge-like structure which allows the cover 180 to pivot upwardly together with the computer screen 188, to the position shown in FIG. 6. Also, Velcro™ or other attachments may be provided for retaining the cover 180 on the upper edge or rear surface of the screen when the latter is in the open position.

In this embodiment, the platform 174 is preferably sized somewhat larger than the dimensions of most commonly available laptop computers, so as to form an open perimeter 176 which extends around the computer inside of the case. This provides an additional impact-absorption "zone" into which the material of the case can deform without the computer itself being struck. Also, with the computer securely attached to the platform 174 by the Velcro™ footings and with the leg straps 142*a,* 142*b* folded over the top of the computer and joined together in the manner previously described, the computer is essentially suspended inside the case, with an open "crush" space formed between it and the fabric cover on all sides. Furthermore, the protruding edge of the platform provides a rigid "bumper" all the way around the computer. This combination provides effective impact protection for the computer without requiring an excessively bulky case or the use of expensive cushioning materials all the way around.

Although the present invention has been described herein with reference to an embodiment in which the assembly serves as a detachable "accessory" for use with a computer having an otherwise conventional configuration, it will be understood that in some embodiments, the band and pad portions may be mounted directly to the computer case, thereby dispensing with need for the plate member. Also, various fastening structures and configurations may be used in addition to or in place of those which are described herein. For example, buckles, buttons, snaps, and other fasteners may be used in addition to or in place of the hook-and-loop material which has been employed throughout the exemplary embodiment shown herein. Moreover, the various layers of Velcro™ or other hook-and-loop fabric material may be reversed or otherwise rearranged from the exemplary positions which have been described herein. It is therefore to be recognized that these and various other alterations, modifications, and/or additions may be introduced into the constructions and arrangements of parts described above without departing from the spirit or ambit of the present invention as defined by the appended claims.

What is claimed is:

1. A leg-worn support assembly for a laptop computer, said assembly comprising:

a substantially planar, rigid platform member having an upper surface for attachment to a laptop computer;

a pad member mounted to a lower surface of said platform member, said pad member froming a channel area for receiving an upper edge of a user's leg;

first and second leg straps mounted to first and second edges of said platform member and depending therefrom for extending around a user's leg;

said first and second leg straps comprising tension means for pressing said pad portion downwardly against an upper edge of a user's leg, said tensiion means comprising:

at least one elastomeric segment interconnecting separate upper and lower substantially non-elastomeric portions of at least one of said leg straps so as to exert tension on said straps; and means for connecting ends of said first and second leg straps around a user's leg so said tension exerted by said elastomeric segment presses said channel area into engagement with an upper edge of a user's leg when said support assembly is worn theron.

2. A leg-worn support assembly for a laptop computer, said assembly comprising:

a substantially planar, rigid platform member having an upper surface for attachment to a laptop computer;

a pad member mounted to a lower surface of said platform member, said pad member forming a channel area for receiving an upper edge of a user's leg;

first and second leg straps mounted to first and second edges of said platform member and depending therefrom for extending around a user's leg;

means for connecting ends of said first and second leg straps around a user's leg so as to press said channel area into engagement with an upper edge of a user's leg when said support assembly is worn thereon; and a non-slip surface mounted on an inner surface of a selected one of said leg straps in a position at which said non-slip surface will bear against and frictionally engage a lower surface of a user's leg when said assembly is worn thereon.

3. The support assembly of claim 2, further comprising:

a second non-slip surface mounted on said pad member in said channel area in a position at which said second non-slip surface will bear against and frictionally engage an upper surface of a user's leg when said assembly is worn thereon.

4. The support assembly of claim 3, wherein said non-slip surface on said leg strap is located at a position along said leg strap which is selected so that said non-slip surface on said strap will be positioned substantially diametrically opposite said non-slip surface in said channel area when said assembly is worn on a user's leg.

5. A leg-worn support assembly for a laptop computer, said assembly comprising:

a substantially planar, rigid platform member having an upper surface for attachment to a laptop computer;

a pad member mounted to a lower surface of said platform member, said pad member forming a channel area for receiving an upper edge of a user's leg;

first and second leg straps mounted to first and second edges of said platform member and depending therefrom for extending around a user's leg; and means for connecting ends of said first and second leg straps around a user's leg so as to press said channel area into engagement with an upper edge of a user's leg when said support assembly is worn thereon, said means for connecting said ends of said strap comprising:

a first laver of hook-and-loop material mounted on an outer surface of an end of said first leg strap; and a second layer of hook-and-loop material mounted on an inner surface of an end of said second leg strap which overlaps said end of said first strap, so that said first and second layers of hook and loop material overlie and engage one another when said straps extend around a user's leg;

said leg straps further being configured to extend over an upper surface of said platform member so that said ends thereof overlap and said layers of hook-and-loop material thereon engage one another so that said straps form a protective cover for a computer which is attached to said platform member.

6. The support assembly of claim 5, further comprising:

an upper cover member which is detachably mounted around an edge of said platform member, for enclosing a laptop computer which is mounted to said plate member when said computer is not in use.

7. A leg-worn support assembly for a laptop computer, said support assembly comprising:

a substantially rigid platform member having a generally planar upper surface;

means for detachably mounting said upper surface of said platform member to a lower surface of a laptop computer;

a pad member mounted to a lower surface of said platform member, said pad member forming a channel area for receiving an upper edge of a user's leg;

a first non-slip surface mounted on said pad member in said channel area for bearing against and frictionally engaging an upper edge of a user's leg in said channel area;

first and second leg straps mounted to first and second edges of said platform member and depending therefrom for extending around a user's leg;

a second non-slip surface mounted on a selected one of said leg straps for bearing against and frictionally engaging a lower surface of a user's leg, said second non-slip surface being located on said strap so as to be positioned generally opposite said non-slip surface in said channel area when said assembly is worn on a user's leg;

means for detachably connecting ends of said first and second leg straps around a user's leg; and means for tensioning said leg straps around a user's leg, so as to press said first and second non-slip surfaces towards on another into frictional engagement with a user's leg when said assembly is worn thereon.

8. A leg-worn support assembly for a laptop computer, said assembly comprising:

a substantially planar, rigid platform member having an upper surface for attachment to a laptop computer;

a pad member mounted to a lower surface of said platform member, said pad member forming a channel area;

first and second leg straps mounted to first and second edges of said platform member and depending therefrom;

means for connecting ends of said first and second leg straps under said rigid platform so as to surround a user's leg and press said channnel area into engagement with an upper edge thereof; and means for connecting ends of said first and second leg straps over said rigid platform, so that said straps form a protective cover for a laptop computer attached to said platform.

9. The support assembly of claim 8, wherein said means for connecting said ends of said first and second straps under said rigid platform comprises:

a first layer of hook-and-loop material mounted on an outer surface of an end of said first leg strap; and a second layer of hook-and-loop material mounted on an inner surface of an end of said second leg strap;

said ends of said straps being configured to overlap so that said first and second layers of hook and loop material thereon engage one another when said straps meet under said platform.

10. The support assembly of claim 9, wherein said means for connecting said ends of said first and second leg straps over said rigid platform comprises:

said first and second layers of hook material on said ends of said first and second leg straps;

said ends of said straps being configured to overlap so that said first and second layers of hook-and-loop material thereon engage one another when said straps meet over said platform.

* * * * *